US006982680B2

(12) United States Patent
Janoschka et al.

(10) Patent No.: US 6,982,680 B2
(45) Date of Patent: Jan. 3, 2006

(54) ANTENNA TOWER AND SUPPORT STRUCTURE THEREFOR

(75) Inventors: Darin M. Janoschka, Roswell, GA (US); John L. Beafore, Duluth, GA (US); Anthony W. Peavy, Lawrenceville, GA (US)

(73) Assignee: EMS Technologies, Inc., Norcross, GA (US)

( * ) Notice: Subject to any disclaimer, the term of this patent is extended or adjusted under 35 U.S.C. 154(b) by 138 days.

(21) Appl. No.: 10/615,893

(22) Filed: Jul. 8, 2003

(65) Prior Publication Data

US 2005/0007295 A1 Jan. 13, 2005

(51) Int. Cl.
*H01Q 1/12* (2006.01)

(52) U.S. Cl. ..... 343/878; 343/891

(58) Field of Classification Search ..... 343/761, 343/763, 812–817, 799, 800, 878, 890–893, 343/879

See application file for complete search history.

(56) References Cited

U.S. PATENT DOCUMENTS 3,681,770 A * 8/1972 Alford ..... 343/815
5,966,102 A * 10/1999 Runyon ..... 343/820
6,222,503 B1 * 4/2001 Gietema et al. ..... 343/890

OTHER PUBLICATIONS

EMS Wireless, 1850-MHz—1990 MHz Product Catalog, Jan. 2001, www.emswireless.com, Norcross, GA 30071.

* cited by examiner

*Primary Examiner*—Michael C. Wimer
(74) *Attorney, Agent, or Firm*—Troutman Sanders LLP

(57) ABSTRACT

An antenna tower and support structure for use with an antenna tower, which allow a number of antennas or antenna panels to be mounted thereto, while maintaining the compactness of the overall structure and still providing high strength, such as is needed to resist high winds. The antenna tower includes an antenna support structure mounted to the antenna mast for supporting one or more antennas or antenna panels. The antenna support structure includes a bottom plate for mounting to the mast (or to another antenna support structure) and a top plate spaced from bottom plate. A beam with multiple webs extends between the bottom plate and the top plate. The beam includes a central post and a number of stiffening webs extending generally radially outwardly from the central post. The stiffening webs help to provide substantially greater stiffness against flexure and bending, without making the overall structure larger (or not much larger effectively). In this way, an antenna tower can be constructed that meets the competing needs of great structural rigidity and compactness.

29 Claims, 22 Drawing Sheets

ANTENNA TOWER AND SUPPORT STRUCTURE THEREFOR

TECHNICAL FIELD

The present invention relates generally to antennas and more particularly to an antenna tower and a support structure for mounting a wireless communications antenna on such a tower.

BACKGROUND OF THE INVENTION

Modern wireless communications systems, such as cellular or personal communication subscriber (PCS) telephone systems, are in wide use around the world. These systems generally include one or more antennas that are mounted on an associated antenna tower. Each antenna tower typically is associated with a base station.

In order to provide wireless service to a given area (service area), wireless service providers normally erect one or more antenna towers at predetermined locations within the service area. As wireless communications services have become more popular, service providers have endeavored to build out wireless communications systems to provide service to larger areas. As a result, it has become common in many communities for there to be several antenna towers dotting the landscape.

Antennas and antenna towers are subjected to demanding environmental factors, such as high winds. Typical antenna towers have been designed and constructed to provide the strength necessary to support an antenna subjected to these environmental conditions. This has meant that the typical antenna mast/tower is large, bulky and generally unappealing in appearance. Often, these antenna towers are obtrusive and contrast sharply with the surrounding environment in a negative way, and are commonly viewed by the community as "eye-sores." This is due in part to the fact that most typical antenna towers have been constructed to provide functionality at the expense of form or aesthetics.

To address this aesthetics issue, efforts have been made in recent years to provide antenna towers, including associated support structures, which are less obtrusive to the eye and more compact in profile/structure. Unfortunately, the needs for high strength have tended to make it difficult to provide a compact structure.

As wireless communication becomes more and more ubiquitous, there is an ever-increasing demand for more antenna towers and for more equipment mounted on a single tower. This demand for greater equipment mounting on a single antenna leads to antenna towers that are bulkier, not more compact, thereby creating a tension between the need for greater capacity and the desire to make the antenna tower more compact (and therefore less obtrusive). The growing demand for greater equipment mounting on individual antenna towers also leads to a need for increased structural strength, due to the greater mass and length of the antenna complex mounted at the top of the tower. This need for increased strength also tends to lead to larger structures, as mentioned above. One approach to this dilemma has been to make the tower and associated equipment as large as desired and then to try to obscure the structure to the greatest extent possible with camouflage techniques to try to blend the tower into the surrounding environment.

Examples of known antenna systems designed to blend into the surrounding area include that shown in U.S. Pat. No. 6,122,866 to Trevor et al., for a Method and Apparatus for Concealment and Disguisement of Antenna Structures, which discloses a support structure (FIG. 1) that resembles a palm tree. U.S. Pat. No. 6,343,440 to Ayers, for Antenna Towers Having A Natural Appearance, also shows an antenna structure that is formed to appear as a palm tree (FIG. 1 and FIG. 2). The Ayers patent also shows an antenna structure formed to resemble a saguaro cactus (FIG. 17 and FIG. 18). Similarly, U.S. Pat. No. 6,434,889 to Jones, for an Antenna Support Structure With Palm Tree Skirt, shows an antenna support structure that includes a plurality of green members and a plurality of drooping members that cause the antenna support structure to resemble a living palm tree. U.S. Design Pat. No. Des. 398,612 to Juengert et al., for an Antenna Support Structure, shows an antenna support structure that strongly resembles a tree.

Other known antenna support systems that take on a somewhat compact profile are shown in U.S. Pat. No. 5,641,141 to Goodwin, for an Antenna Mounting System. In Goodwin, an antenna mounting apparatus is shown which includes three antenna members. The antenna members are positioned so as to provide adequate communications within a selected radial distance. Another antenna system having a somewhat compact profile is shown in U.S. Pat. No. 5,880,701 to Bhame et. al., for an Enclosed Wireless Telecommunications Antenna. Bhame shows an antenna module that is configured to support three dual polarization antenna panels.

At least as early as January 2001, EMS Wireless (a division of EMS Technologies, Inc.), the assignee of the present application, was offering for sale and selling a low-strength antenna support module, which could be mounted atop a mast. The low-strength unit was designed to be used singly or to allow at most two such modules to be stacked together. The module included a lower plate, an upper plate and a central post extending between the plates. The module was shown and described in the January 2001 EMS Wireless Product Catalog. The present inventors, however, have found the low-strength module to be less than ideal in high wind applications or other high strength applications.

Unfortunately, known antenna tower designs generally do not provide the strength to support more than a limited number of antenna panels or external attachments, such as flags, banners, signage and the like, combined with an aesthetically pleasing compact appearance. Further, they generally do not provide the strength needed to withstand harsh environmental stresses, in particular high wind, that are often encountered. This can be particularly important in certain regions, such as coastal areas.

In view of the above deficiencies of the prior art, there is yet a need for a compact antenna tower and support structure that is capable of accommodating more than a limited number of antennas or antenna panels. Further, there is a need for a compact antenna tower/support structure that is capable of supporting external attachments, such as flags, banners, signage and the like. Further, there is a need for such compact antenna tower/support structures to be capable of withstanding high winds. It is to the provision of such an antenna tower and support structure therefor that the present invention is primarily directed.

SUMMARY OF THE INVENTION

Briefly described, the present invention is an antenna tower and a support structure for use with an antenna tower, which allow a number of antennas or antenna panels to be mounted thereto, while maintaining the compactness of the overall structure and still providing high strength, such as is needed to resist high winds. In one preferred aspect, the invention preferably comprises an antenna tower including a mast. The antenna tower according to this preferred aspect of the invention also includes an antenna support structure mounted to the antenna mast for supporting one or more antennas or antenna panels. The antenna support structure includes a bottom element for mounting to the mast (or to another antenna support structure) and a top element spaced from the bottom element. A beam with multiple webs extends between the bottom element and the top element. The beam includes a central post and a number of stiffening webs extending generally radially outwardly from the central post. The stiffening webs help to provide substantially greater stiffness against flexure and bending, without making the overall structure larger (or not much larger effectively) or heavier. In this way, an antenna tower can be constructed that meets the competing needs of great structural rigidity, compactness, and light weight.

In another aspect, the invention comprises an antenna tower that includes a mast and at least three antenna support modules mounted atop the mast. Each of the antenna support modules includes a top plate, a bottom plate, and a high-strength beam extending therebetween. The high-strength beam provides the bending strength needed to allow three or more such modules to be stacked atop the mast. Preferably, the high-strength beam includes a central post and a plurality of reinforcing gussets or other stiffening structures extending radially outwardly from the central post.

In another preferred aspect, the invention comprises an antenna support module for mounting to an antenna mast. The support module according to this aspect of the invention preferably includes a bottom plate for mounting to the mast or to another module, and a top plate spaced from the bottom plate. A beam extends between the bottom plate and the top plate. The beam includes multiple vanes that extend outwardly from a central post. Preferably, each of the vanes terminates in a distal flange which extends across the end of the vane.

The configuration, quantity, orientation, and other particulars of the webs or vanes according to these first two aspects of the invention can be varied widely according to the present invention. As will be explained in more detail below, three such webs or vanes can be employed, or four or more. Indeed, even as few as two such vanes or webs could be employed in some situations. Moreover, the webs or vanes could be evenly spaced or unevenly spaced from one another. The webs or vanes could be perforated or solid. The webs or vanes can be of different sizes, shapes, or construction. Furthermore, the webs or vanes can be used with or without flanges, although it is preferred that flanges be formed or attached to the ends of the webs or vanes to provide even more stiffness against bending. Other features and advantages of the present invention will become apparent to those skilled in the art upon examination of the following drawings and detailed description. It is intended that all such additional features and advantages are included herein within the scope of the present invention.

BRIEF DESCRIPTION OF THE DRAWINGS

The invention can be better understood with reference to the following drawings. The components in the drawings are not necessarily to scale. Instead, emphasis is placed upon clearly illustrating the principles of the present invention. Moreover, in the drawings, like reference numerals designate corresponding parts throughout the several views.

DETAILED DESCRIPTION OF THE PREFERRED EMBODIMENT

The present invention provides a compact antenna tower and support structure for use with an antenna tower that are capable of supporting multiple antenna panels. Towers and support structures according to the present invention are also capable of withstanding high winds. Moreover, because of the very good stiffness and strength obtained, the present invention allows the use of multiple support modules stacked on top of one or above another atop a tower mast, while still providing good resistance against excessive flexure from wind. Other modular structures, such as a support module for tower-mounted electronics, can be stacked between antenna support modules. It should be understood that the invention is not to be limited to the mounting of antennas or antenna panels, but instead could be used to mount a wide variety of components on a communications tower. The invention also allows the mounting of items not directly associated with wireless communications, such as a large flag on the top thereof (or other structures) that tend to create large bending loads, due to the enhanced structural rigidity afforded by the beam design of the present invention.

Figure 1A:
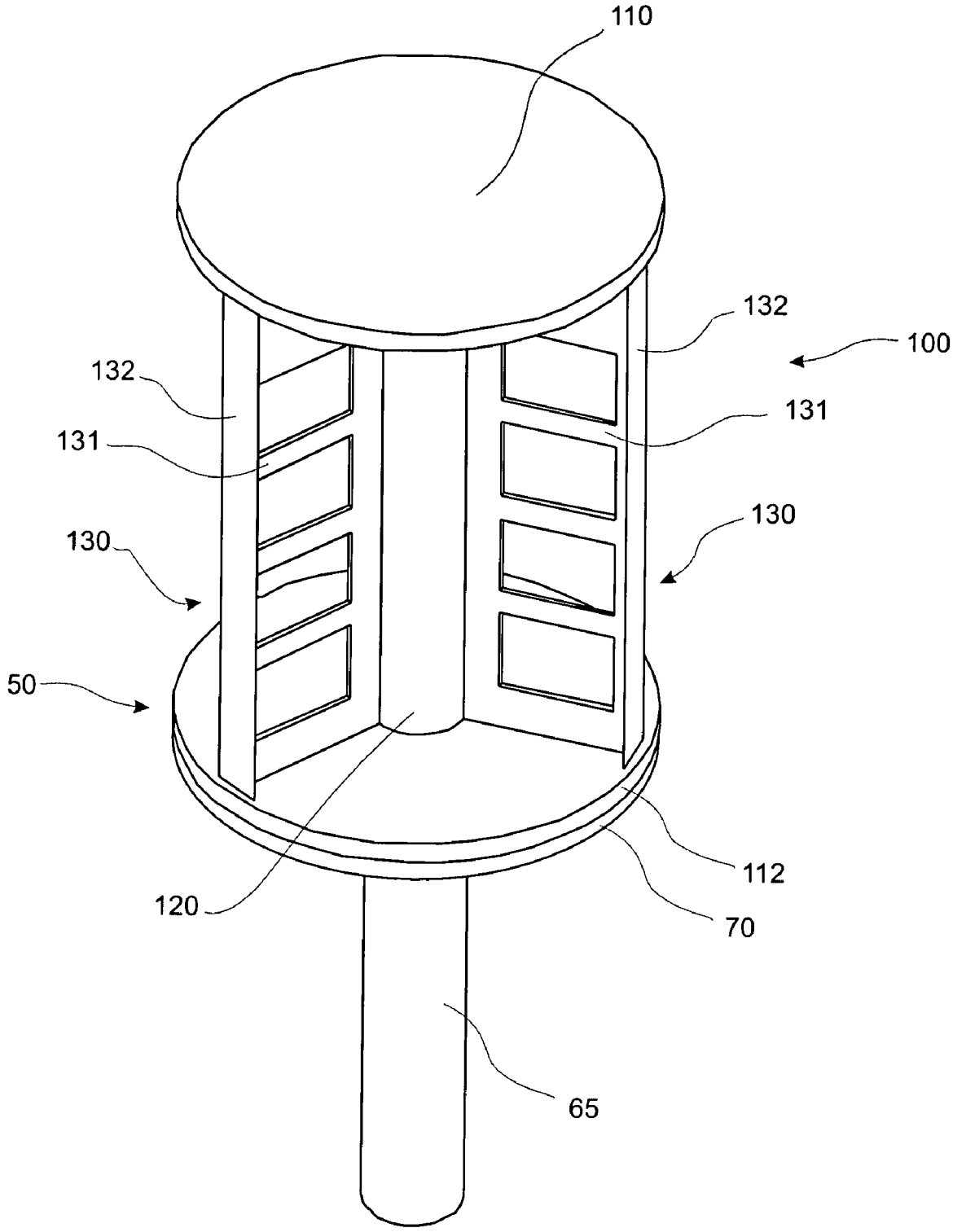
FIG. 1A is a perspective, schematic illustration of an antenna tower according to a first preferred form of the invention.
Figure 1B:
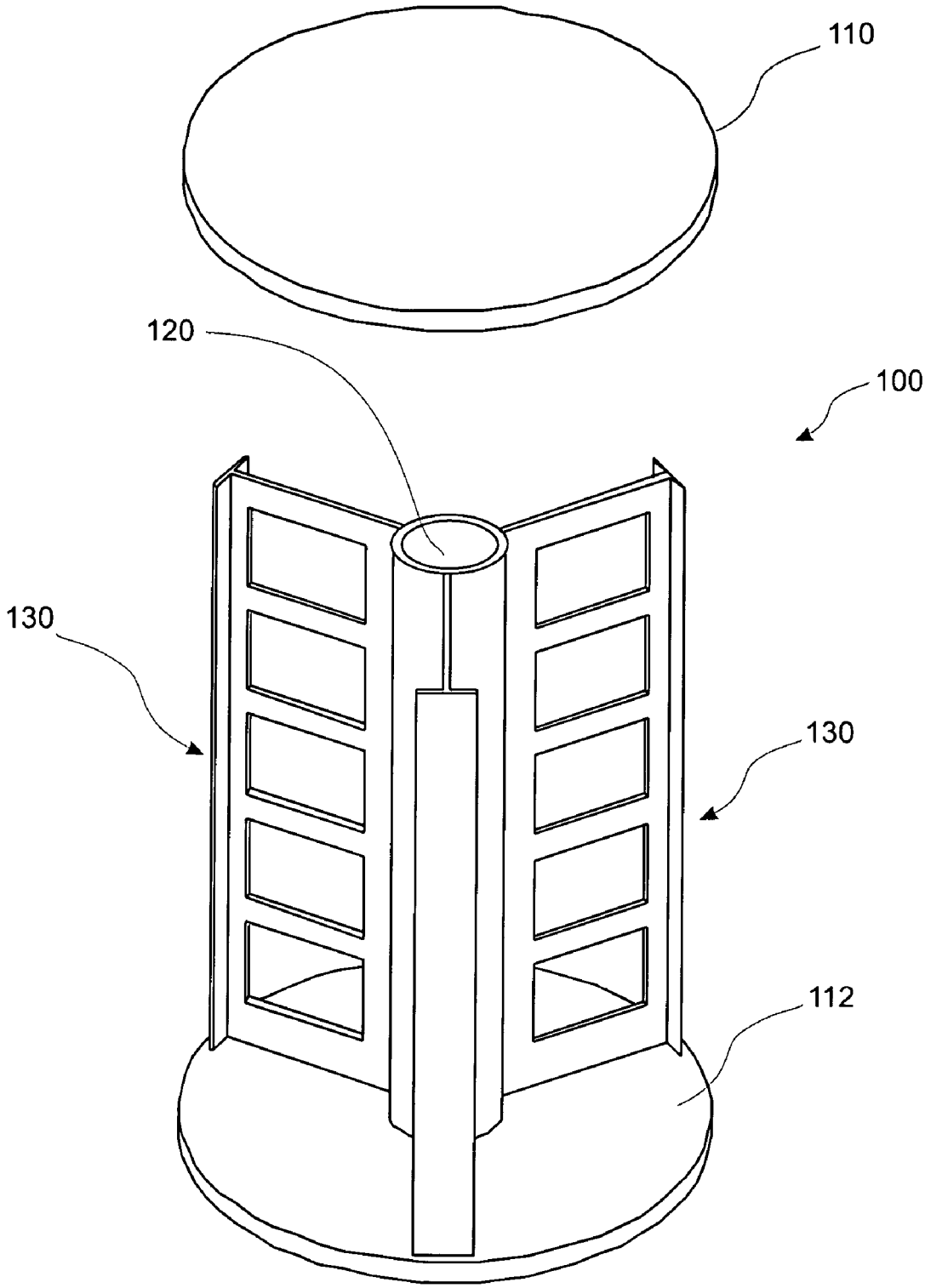
FIG. 1B is a perspective, partially exploded, schematic illustration of a portion of the antenna tower of FIG. 1A.

Referring the reader now to FIGS. 1A and 1B, the general principles of the present invention can be seen. As shown therein, a wireless communications tower 50 includes a tower mast or tower pole 65 of conventional design. The mast 65 typically is mounted at its base to the ground or to a building. The mast 65 terminates in an upper mounting plate 70, which ordinarily comprises a flat plate or mounting receptacle to which another structure can be mounted. The mast 65 can be of a different dimension (e.g., diameter) that the antenna panel support structure 100. The typical manner of securing another structure to the mounting plate 70 is by using threaded fasteners (i.e., nuts and bolts). As shown in the figures, an antenna panel support structure 100 is connected to the mast or pole 65. In particular, the support structure or support module 100 includes a bottom plate or floor 112 which is bolted to the upper mounting plate 70 of the mast 65 using threaded fasteners (not shown). As will become more apparent in connection with subsequent figures, the support structure 100 can be considered a "module" at least in part because it allows more than one such module to be mounted atop the mast, one on top of another in more or less modular fashion.

In addition to the bottom plate or lower mounting plate 112, the support structure 100 also includes a top plate or ceiling or cap 110. The top plate 110 and the bottom plate 112 are designed to work together, to allow a support structure 100 to be mounted atop a tower mast directly or to be mounted atop another support structure 100. A center member or central post 120 is provided and extends between the top plate 110 and the bottom plate 112. The central post is rigidly secured to the upper plate and the lower plate, as by welding or some other known technique. The central post preferably is perpendicular to the upper and lower plates. As shown, one or more wings 130 are rigidly mounted to the central post along some or all of its length, as for example by welding, and extend radially outwardly. They also are welded, at least in some places, to the top plate 110 and to the bottom plate 112. These wings function to stiffen the structure against bending loads (they also provide some additional axial compression strength). Together, the central post and the outwardly extending wings are sometimes referred to herein as a "beam." Although "beams" are more often thought of as horizontal members (and less commonly vertical) and here the beam is vertical, this structure according to the present invention can be described as a "beam" inasmuch as it bears bending loads across its axial length instead of only compression loads along its length.

The wings 130 each preferably include a web portion 131 and a flange portion 132. Both the web portions 131 and the flange portions 132 extend from the lower mounting plate 112 to the upper plate 110. The webs or vanes or stiffening gussets 131 extend outwardly from the central post 120. It is preferred that the webs extend radially outwardly from the central post. Moreover, while it is preferred that the webs terminate in the flanges 132, it should be recognized that in some circumstances the flanges 132 could be dispensed with. For example, if a flange would interfere with or adversely affect an antenna's beam, it might be helpful to eliminate the flange. In that instance, the strength could be maintained at a similarly high level by thickening or widening the web (it would also be helpful to secure the web at the top and bottom to the top and bottom plates). In other circumstances, it might even be possible to omit the webs and to secure the flanges to the upper and lower plates. In all of these variations, the manner of making the panel support structure stronger against bending forces takes advantage of beam design principles in which as the structure is placed under bending stresses, one part of the structure is placed in tension, while another part is placed in compression. Moreover, by spacing these tension and compression elements apart, greater resistance to bending is achieved. These principles are at work in the present invention.

The wings 130 each preferably include perforated or discontinuous webs 131, as shown in these figures. Alternatively, the webs could be made solid, which adds some weight and some strength. But the discontinuous webs have been found to provide adequate additional strength over known prior art designs and do so while minimizing weight and providing good structural opportunities for mounting antenna panels and other items to the support structure 100. The webs depicted show a uniform pattern of openings, but it should be understood that the invention is not to be limited to a fixed and repeating pattern of openings.

In this embodiment the top and bottom plates 110 and 112 preferably are circular in shape. Further, the central post 120 preferably is aligned with the center points, respectively, of both top plate 110 and bottom plate 112. It will be recognized that the plates 110 and 112 may be configured to have a shape other than a generally circular shape, including, but not limited to, a square, rectangular or triangular shape. In particular, the plates 110 and 112 could be configured to have a shape to complement the pattern of the wings, such as a generally triangular shape to match three wings. Also, these mounting plates carry holes formed therein (see FIG. 1C) to facilitate easy mounting to the upper mounting plate 70 of the tower mast 65.

Figure 1C:
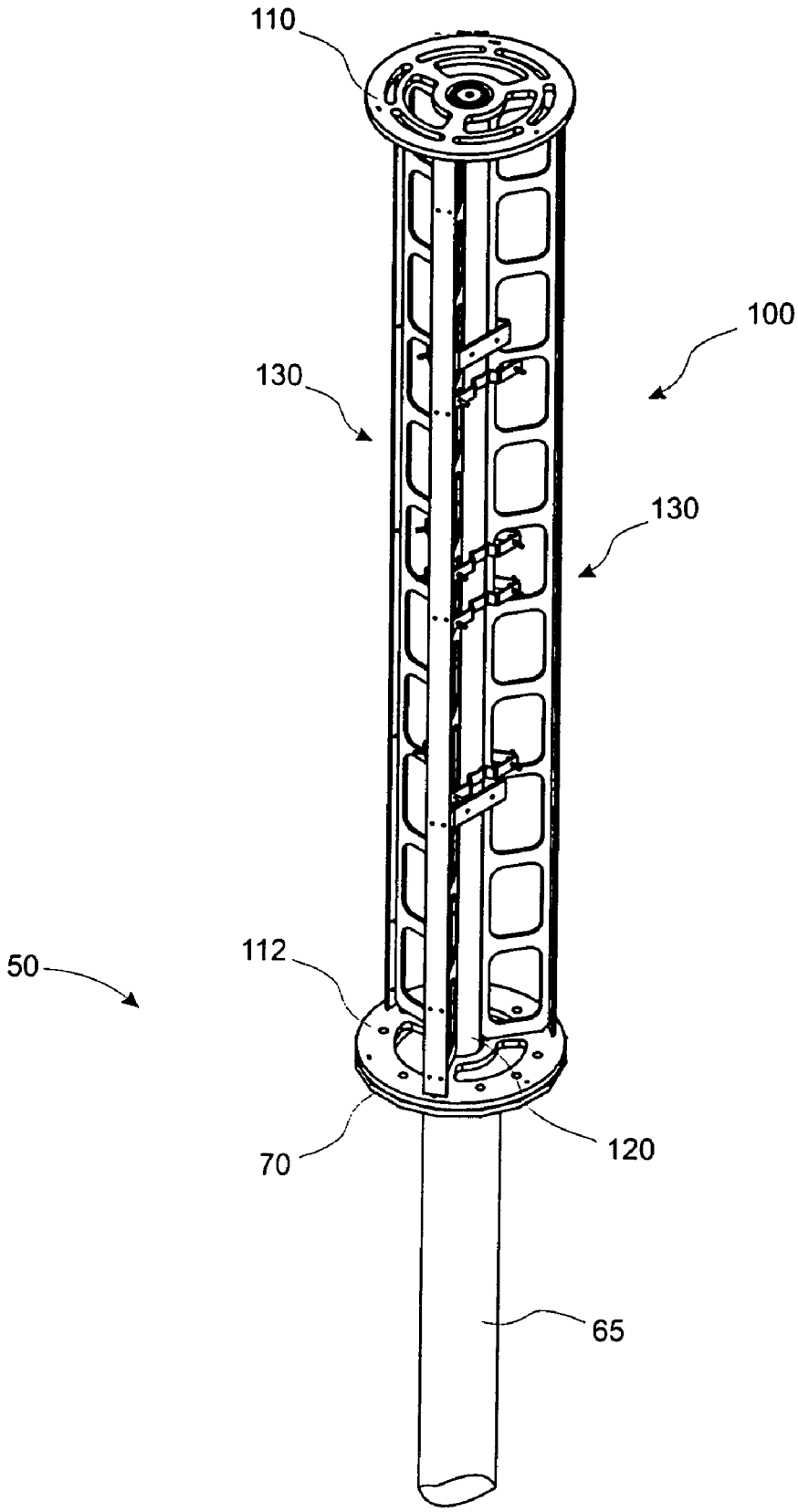
FIG. 1C is a perspective illustration of a commercial form of the antenna tower according to the first preferred form of the invention.

Referring now to FIG. 1C, a commercial form of the tower assembly 50 of FIGS. 1A and 1B is shown. As seen in this figure, the upper and lower plates 110, 112 of the support module 100 include a variety of bolt holes and openings to facilitate the attachment of the support module to the tower mast (or to another support module). The bolt holes and openings preferably are configured to allow the support module to be mounted to the mast in a wide range of azimuth angular orientations. Likewise, the bolt holes and openings preferably allow a second support module, when mounted atop another support module, to be mounted in a wide range of azimuth angular orientations with respect to the first support module. In other words, the individual support modules do not have to be aligned to point in the same direction (although they can); instead the support modules can be oriented to point in different directions.

Figure 2A:
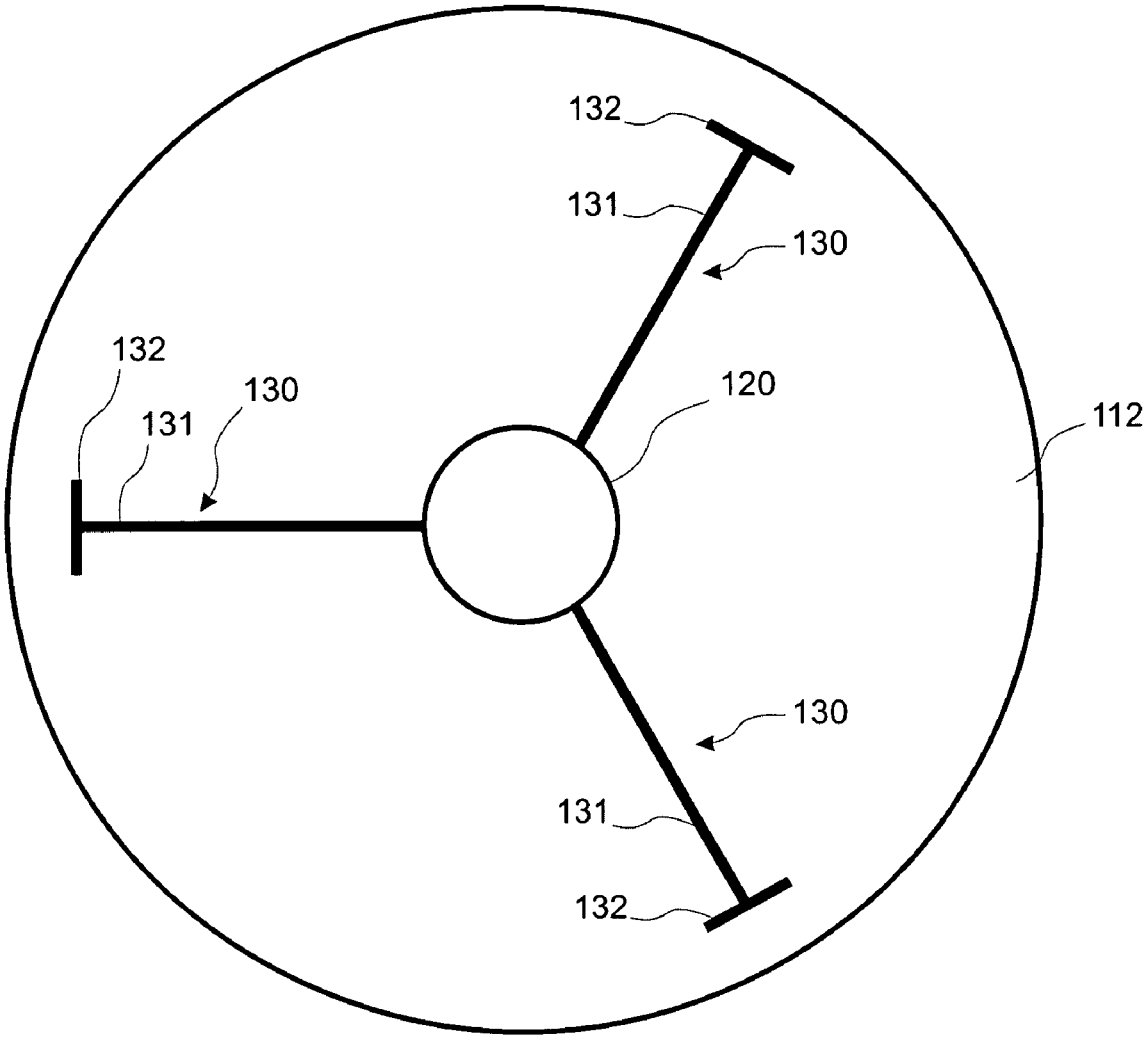
FIG. 2A is a top, sectional schematic view of a portion of the antenna tower of FIG. 1A.
Figure 2B:
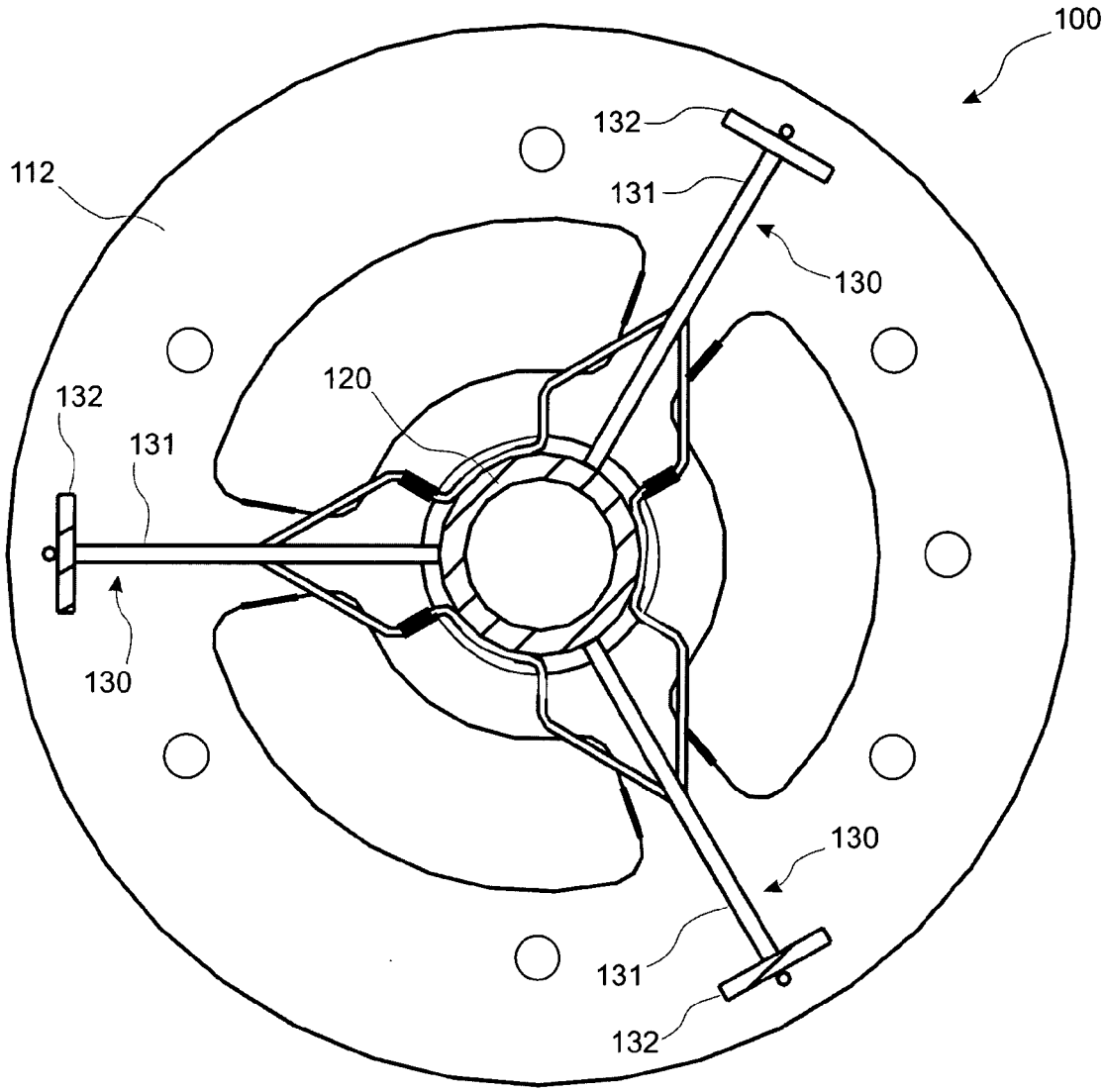
FIG. 2B is a top, sectional view of a portion of the commercial form of the antenna tower of FIG. 1C.
Figure 2C:
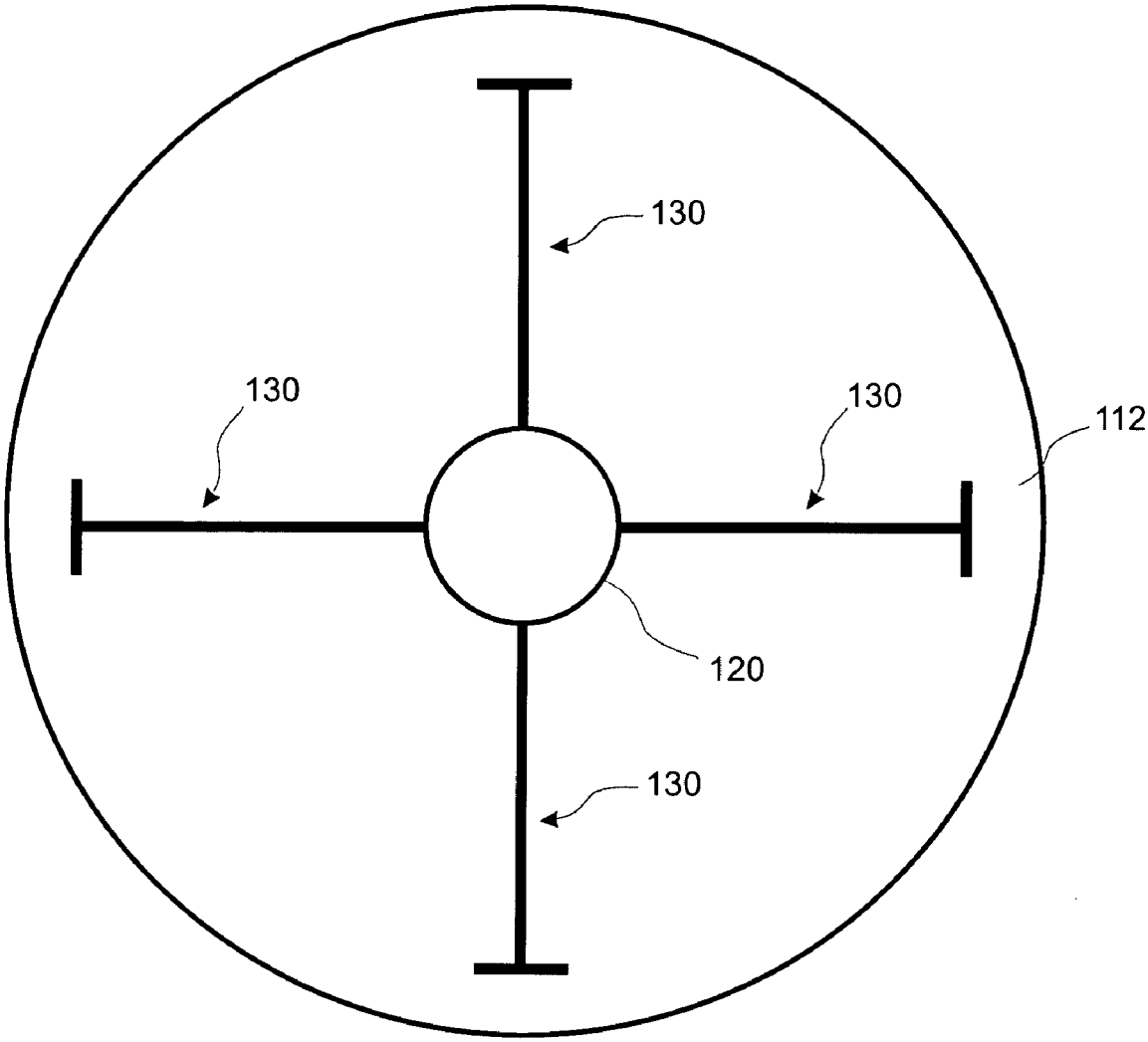
FIGS. 2C–2E are top, sectional schematic views of a portion of the antenna tower of FIG. 1A, in modified or alternative forms.
Figure 2D:
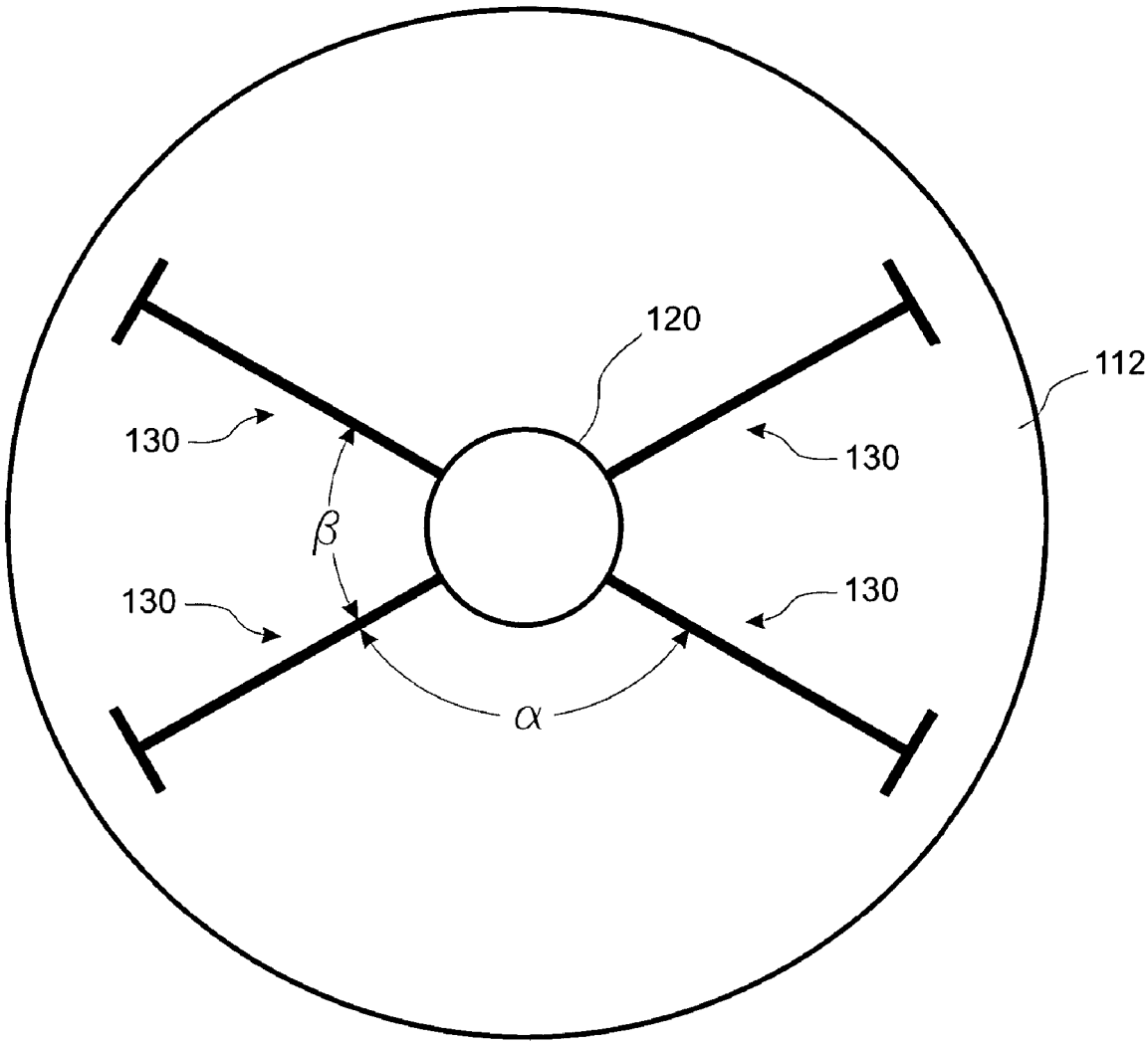
Figure 2E:
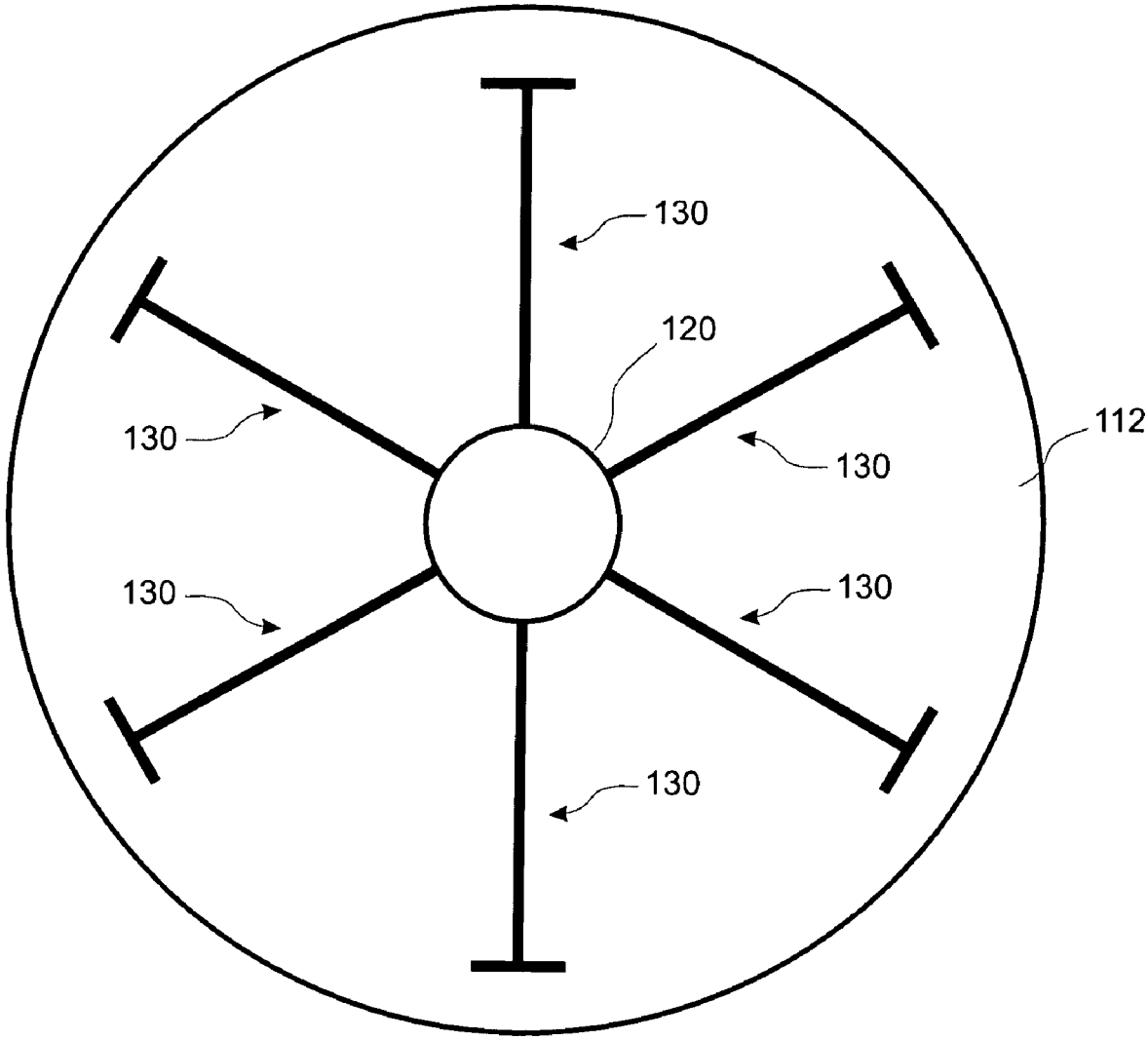

FIGS. 2A and 2B are top sectional views of the support structure 100 of FIGS. 1A–1C, with FIG. 2A being rather schematic in nature and FIG. 2B showing the commercial form. The general configuration of wing members 130 in relation to central post 120 is shown in these diagrams. It can be seen that three wing members 130 are preferably radially aligned with the central post 120. In a preferred embodiment, the wing members 130 are connected to the central post 120 as shown. In the tri-wing design shown in these two figures, the wings 130 are evenly spaced from one another. It should be understood that the wings could be unevenly spaced from one another, if desired for a particular application. Moreover, while three such wings are depicted in the embodiment shown, those skilled in the art will recognize that more or fewer wings could be employed as desired. For example, as shown in FIG. 2C, four such wings 130 can be employed. As shown in FIG. 2E, six such wings 130 can be employed. Also, as shown in FIG. 2D, the spacing between the wings 130 need not be even. As shown in this figure, the spacing between some of the wings forms a first, obtuse angle $\alpha$, and the spacing between others forms a second, acute angle $\beta$. In an alternative embodiment (not shown), the wing members 130 may be configured so that they do not connect directly with a central post 120, but instead connect to each other (the central post being omitted). Also, while the wings within a module are shown as being identical to one another, they could be different from one another, if desired.

Figure 3A:
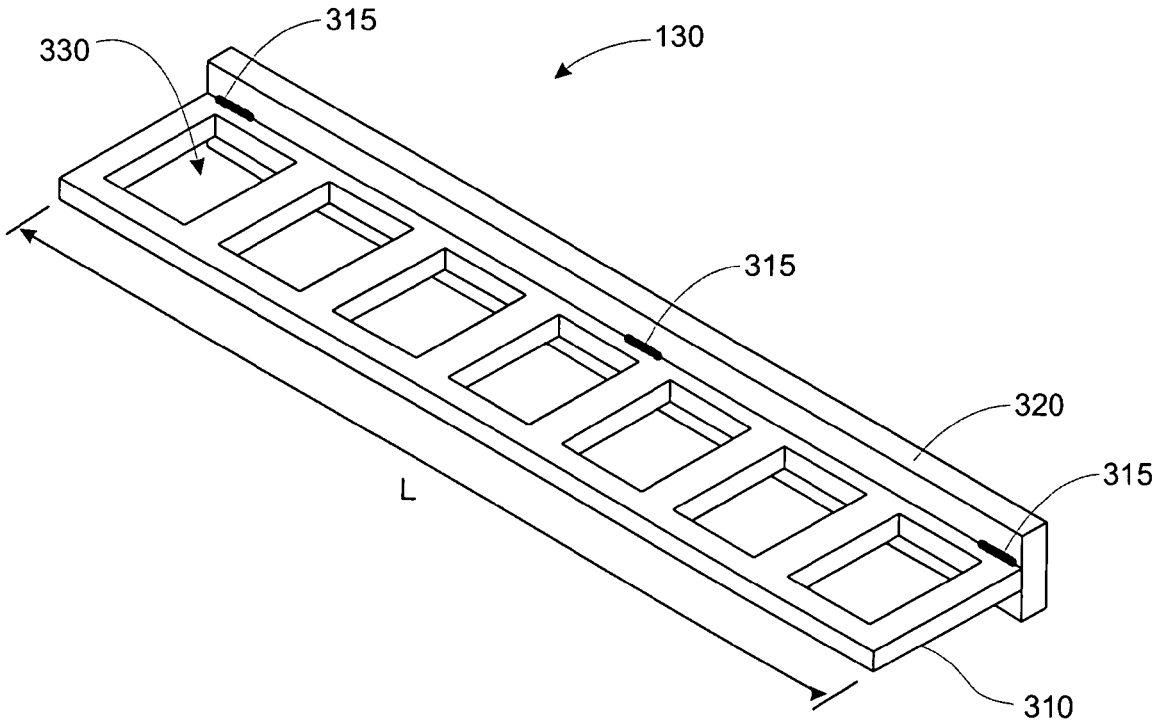
FIG. 3A is a perspective, schematic view of a portion of the antenna tower of FIG. 1A.
Figure 3B:
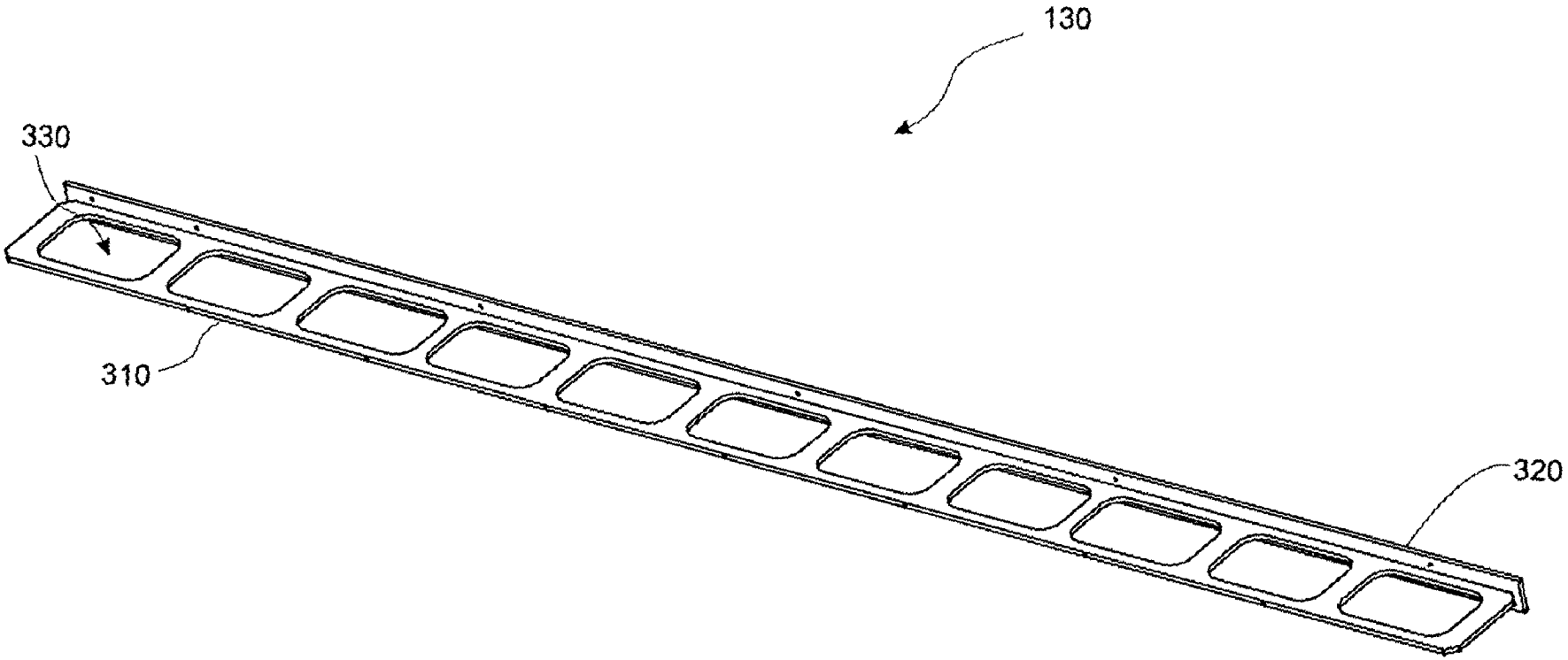
FIG. 3B is a perspective view of a portion of the commercial form of the antenna tower of FIG. 1C.

FIGS. 3A and 3B are diagrams illustrating an embodiment of a wing member 130. In this embodiment wing member 130 is configured to include a web or connector member 310 and a support beam or flange 320. The web 310 is constructed as a unitary member having one or more openings 330 formed therein. The openings 330 may be cut or molded into the web and may be used, for example, to route cables between an antenna (not shown) that might be mounted to the support structure 100 and associated components/circuitry (not shown). The flange 320 and the web 310 are configured as separate and distinct pieces that are connected by, for example welding, use of adhesives or mechanical fasteners, such as screws, bolts or rivets. As shown in the figures, the web and the flange can be welded together, preferably at more than one weld 315 located along the length of the web. The web 310 preferably has a length L that is substantially equal to the length of the flange 320. It will be recognized however, that the length of the web 310 may be made shorter than the length of the flange 320, if so desired. Advantageously, the flange 320 is welded (or otherwise rigidly secured) to the upper and lower plates 110 and 112. The web 310 can also be welded to the upper and lower plates.

Figure 3C:
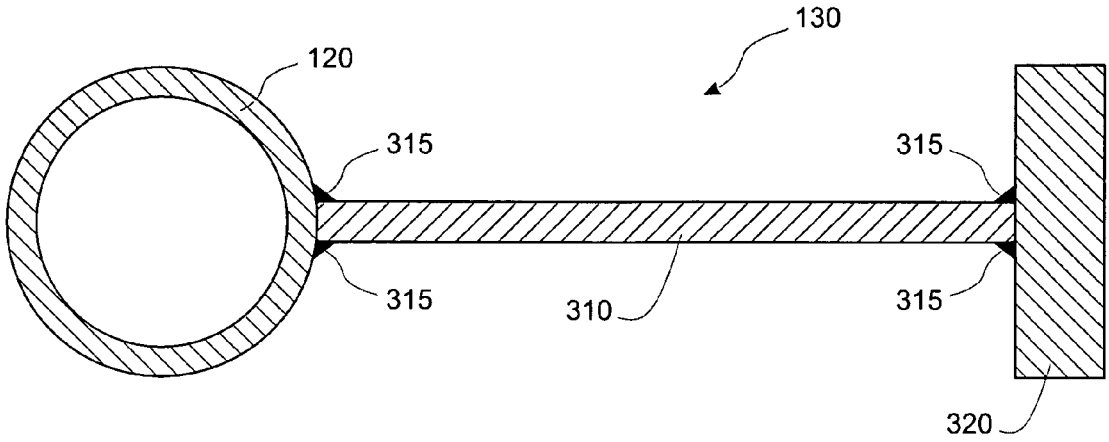
FIGS. 3C–3H are schematic views of a portion of the antenna tower, in various forms.
Figure 3D:
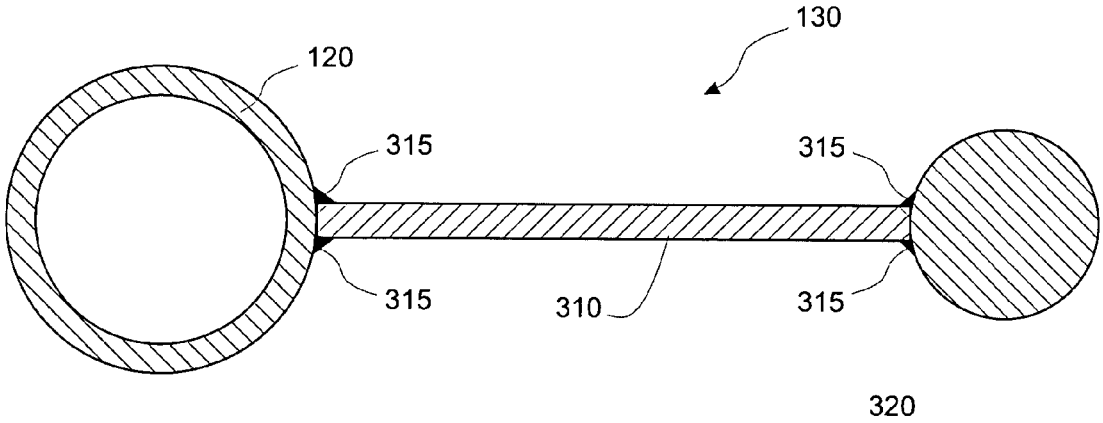

FIGS. 3C and 3D are cross-sectional views of further embodiments of wings 130, with alternative flanges 320. In FIG. 3C the flange 320 is generally rectangular in shape (and solid in cross-section). In FIG. 3D the cross-section of flange 320 is substantially circular in shape (and could be solid or hollow). It will be recognized by those skilled in the art that the flange 320 may also be configured to have a cross-section that is of a different shape, including, but not limited to, semi-circular, triangular, V-shaped or L-shaped. The flange 320 may also be configured to have a cross-section that is of a different orientation.

Figure 3E:
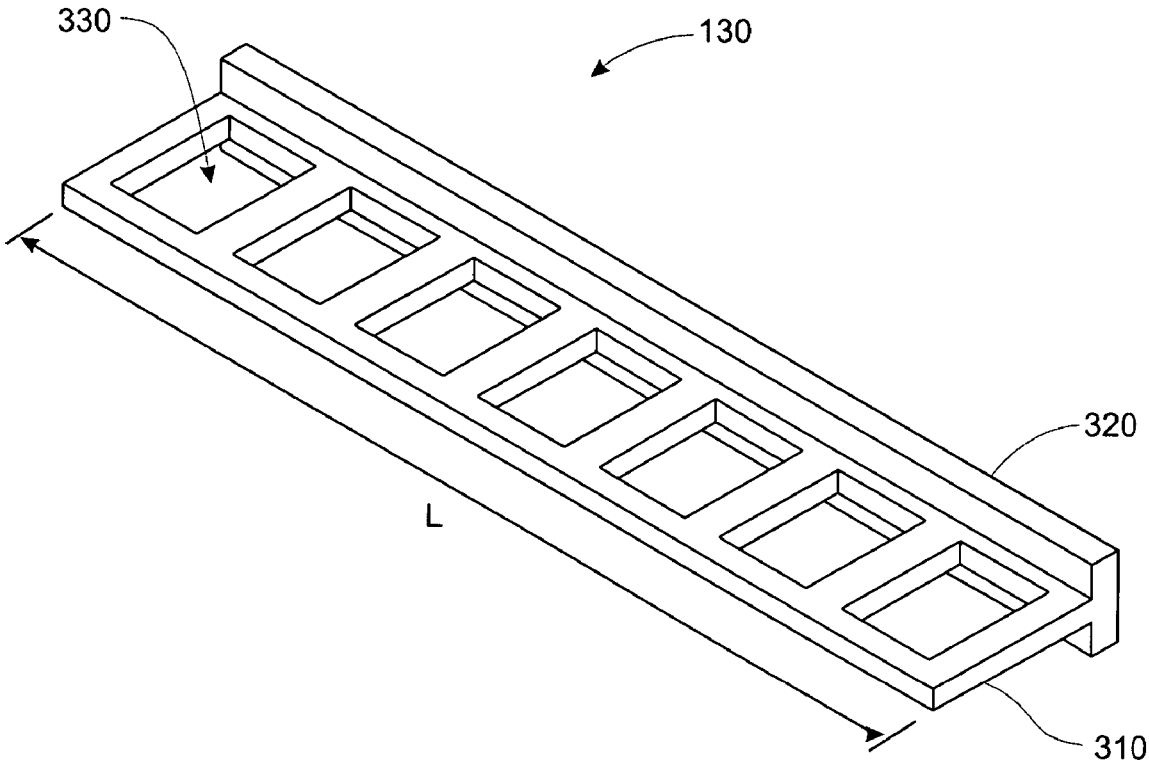
Figure 3F:
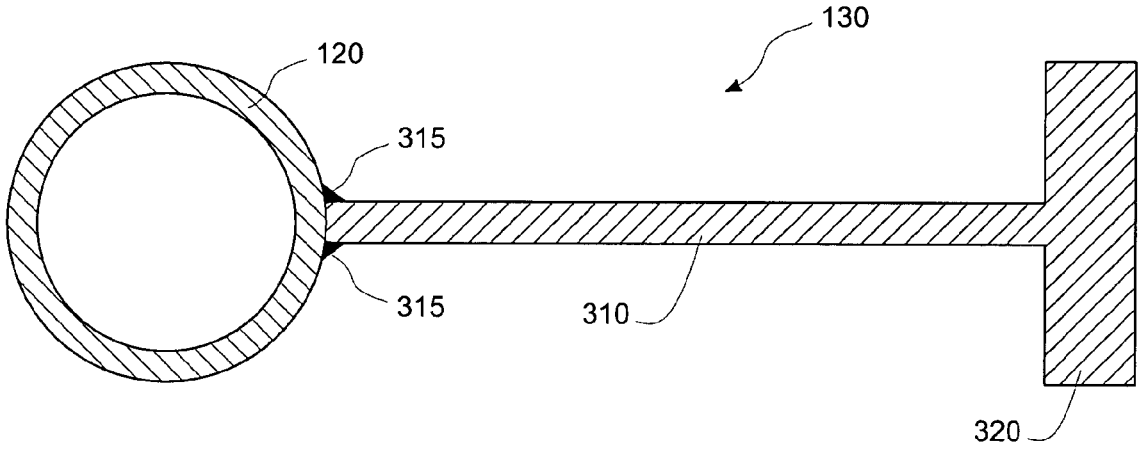

FIG. 3E is a detailed perspective illustration of a further embodiment of the wing member 130 in which the web 310 and the flange 320 are formed as a unitary (one piece) member. FIG. 3F is a cross-sectional view of this embodiment of the wing member 130. It can be seen that in cross-section the wing 130 is generally T-shaped. If made from steel, the wing can be cast or forged as desired. If made from aluminum or similar material, the wing could be fabricated via known extrusion processes. Those skilled in the art will recognize that there are various manufacturing processes that could be employed to manufacture the wing having an integral web and flange (as well as the other embodiments of the wing). In the commercial units as sold in the marketplace, the wing member is made from steel and then plated to resist corrosion. Aluminum could be used, but many customers in the market tend to expect structural components mounted atop the tower mast to be made of steel.

Figure 3G:
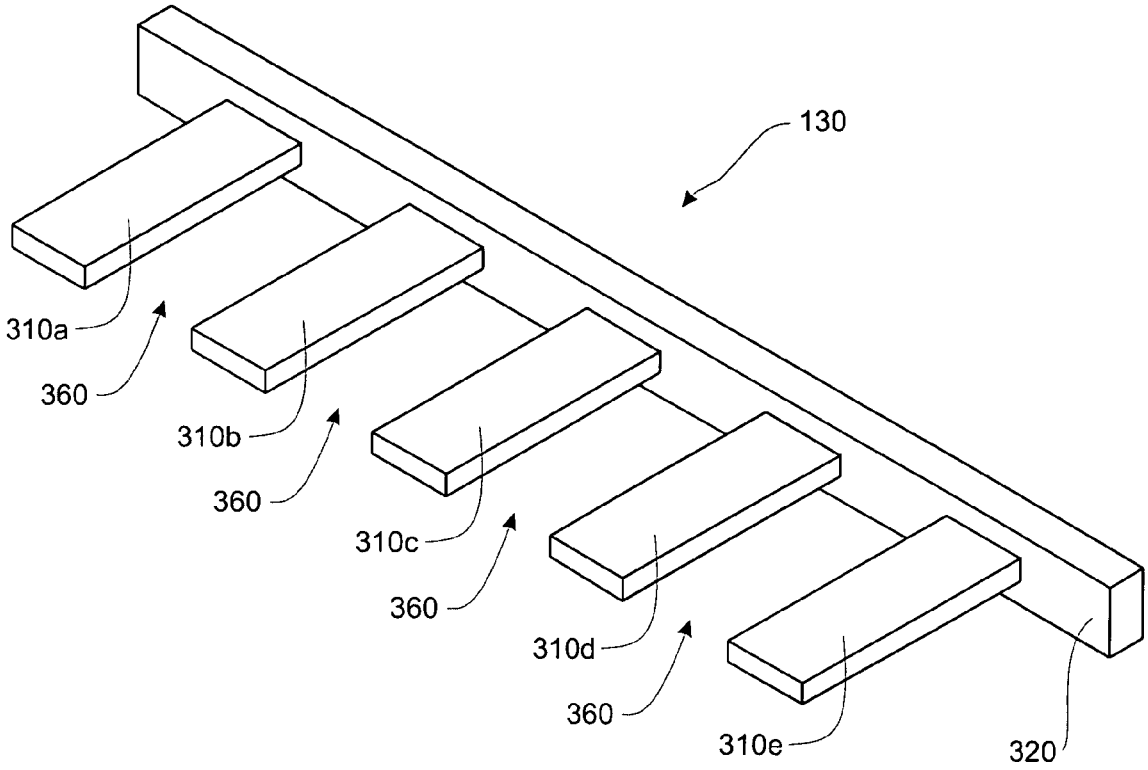
Figure 3H:
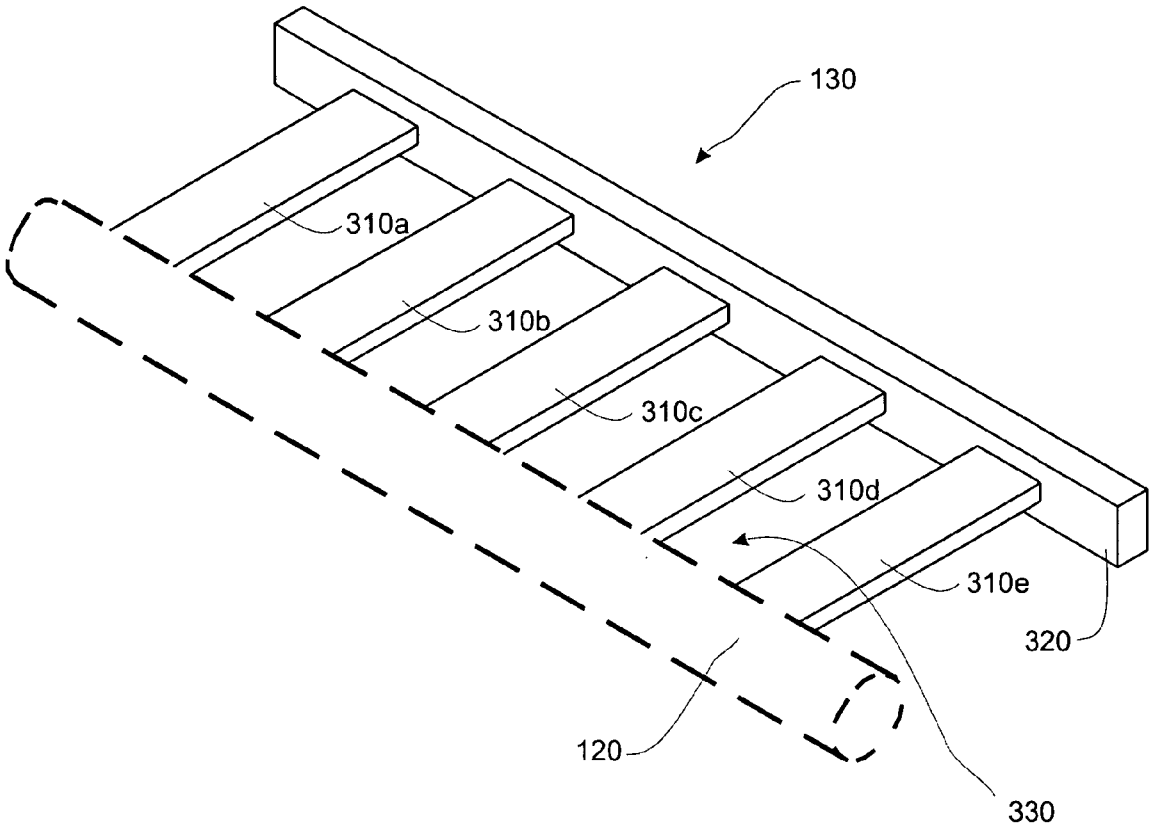

FIGS. 3G and 3H are diagrams illustrating a further embodiment of the wing member 130. In this embodiment the web 310 is formed from a series of connector members 310*a*–310*e*. Each connector member 310*a*–310*e* is configured to extend between the central post 120 and the flange 320. They are spaced apart along the flange 320 by a predetermined distance to create even sized openings 360. The openings 360 allow for easy routing of cables between antenna panels (not shown in these two figures) and associated circuitry and components (also not shown here). While there are a total of five (5) connector members illustrated in this example, it will be recognized that any number of connector members (more or less) may be used, as desired, provided they are configured to provide the strength needed for the application at hand. Each of the connector members 310*a*–310*e* preferably are radially aligned with respect to the center member 120; however, it is not required that they be so aligned.

Figure 4A:
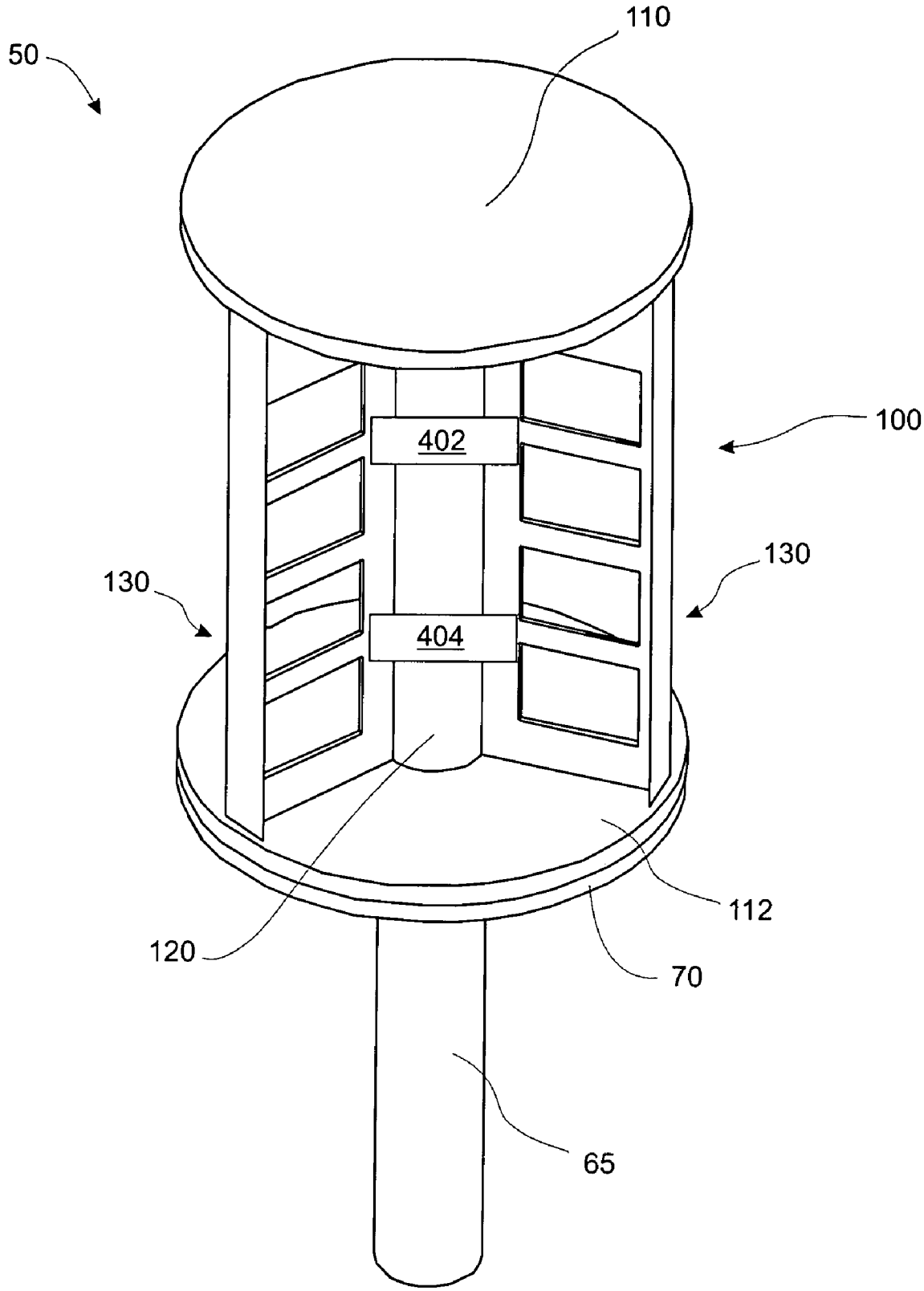
FIG. 4A is a schematic, perspective illustration of an antenna tower according to the present invention and further illustrating mounting brackets for securing antenna panels to the tower.

FIGS. 4A–4D further illustrate support structure 100. With reference to FIG. 4A, it can be seen that in this embodiment mounting brackets 402 and 404 are provided. These mounting brackets may be used to secure or mount an antenna panel, such as a dual polarization antenna panel, to the support structure 100. The mounting brackets can span from one web to an adjacent web and can be configured to circumnavigate the central post. In this regard, the openings formed in the webs can be used to further advantage.

Figure 4B:
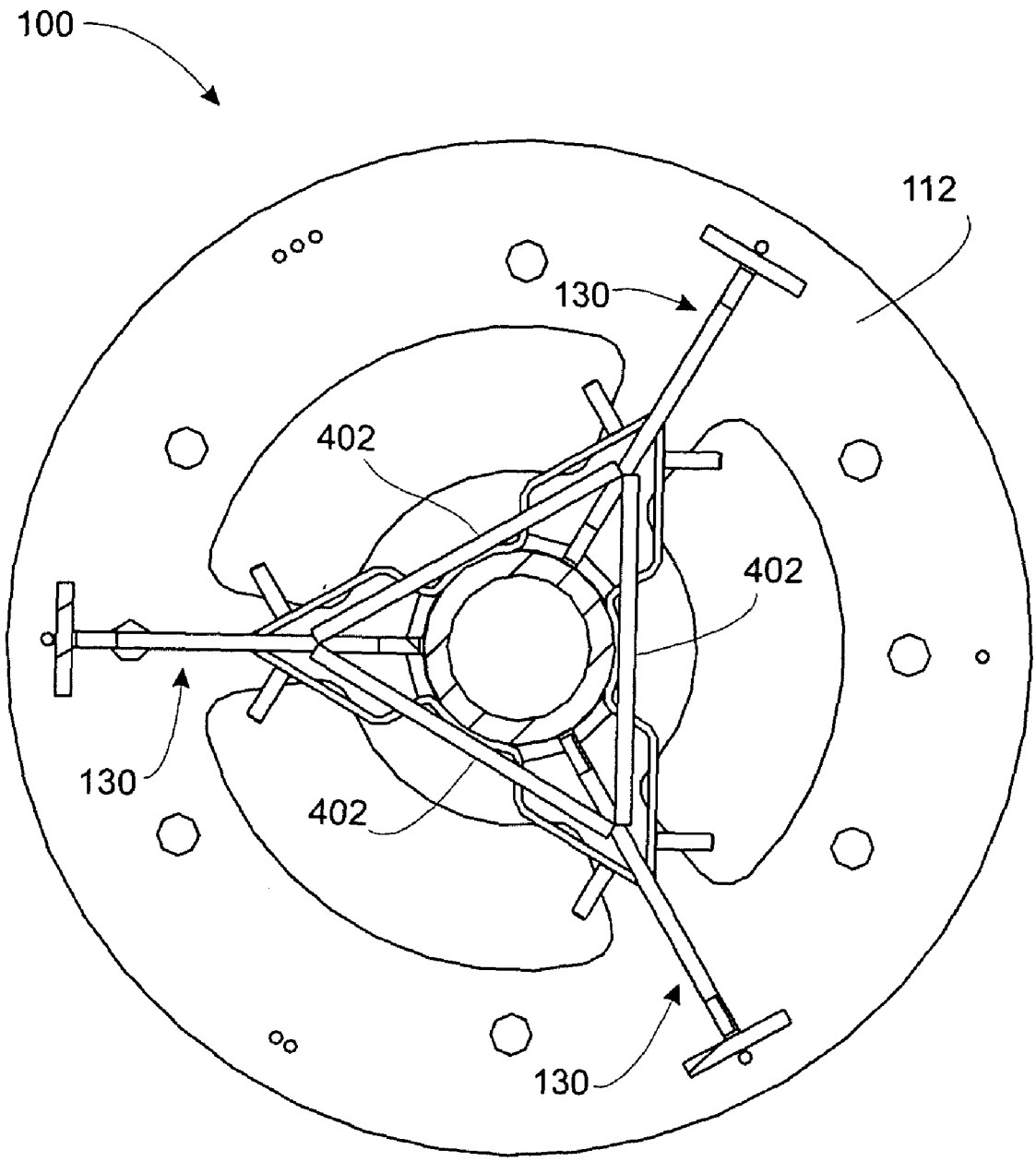
FIG. 4B is a schematic, sectional top view of the support structure shown in FIG. 4A.

FIG. 4B shows a top sectional view of the support structure 100 shown in FIG. 4A. The mounting brackets, such as brackets 402, are provided to allow for the mounting of one or more antennas or panels 75 (FIG. 4C) onto the support structure 100. It can be seen that a set of mounting brackets is provided between each of the wing members 130. Further, the support structure 100 may also be configured to provide for mounting associated components, such as, for example, a low noise amplifier (LNA) (not shown).

Figure 4C:
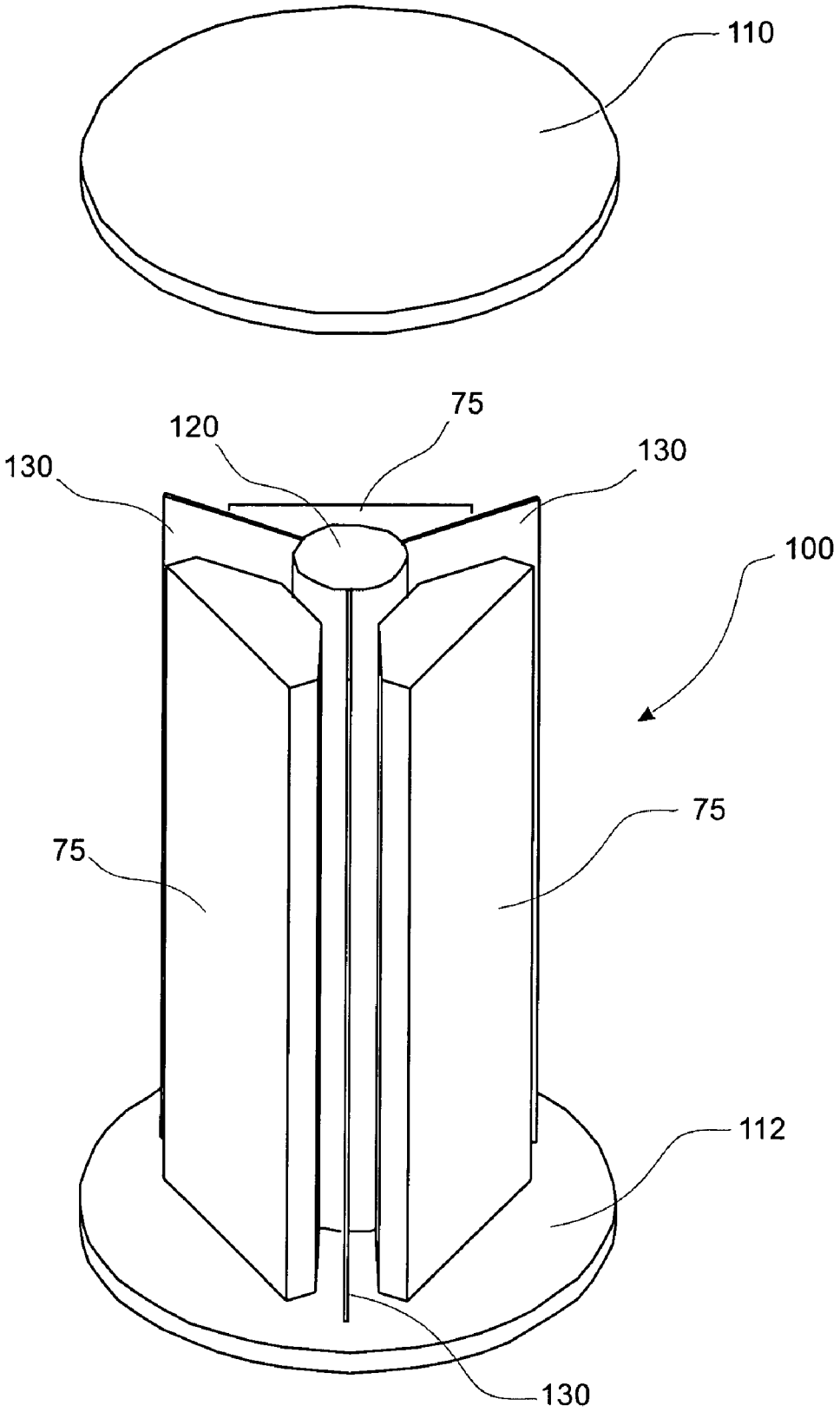
FIG. 4C is a perspective, partly exploded schematic view of the support structure of FIG. 4A, shown with antenna panels mounted thereto.
Figure 4D:
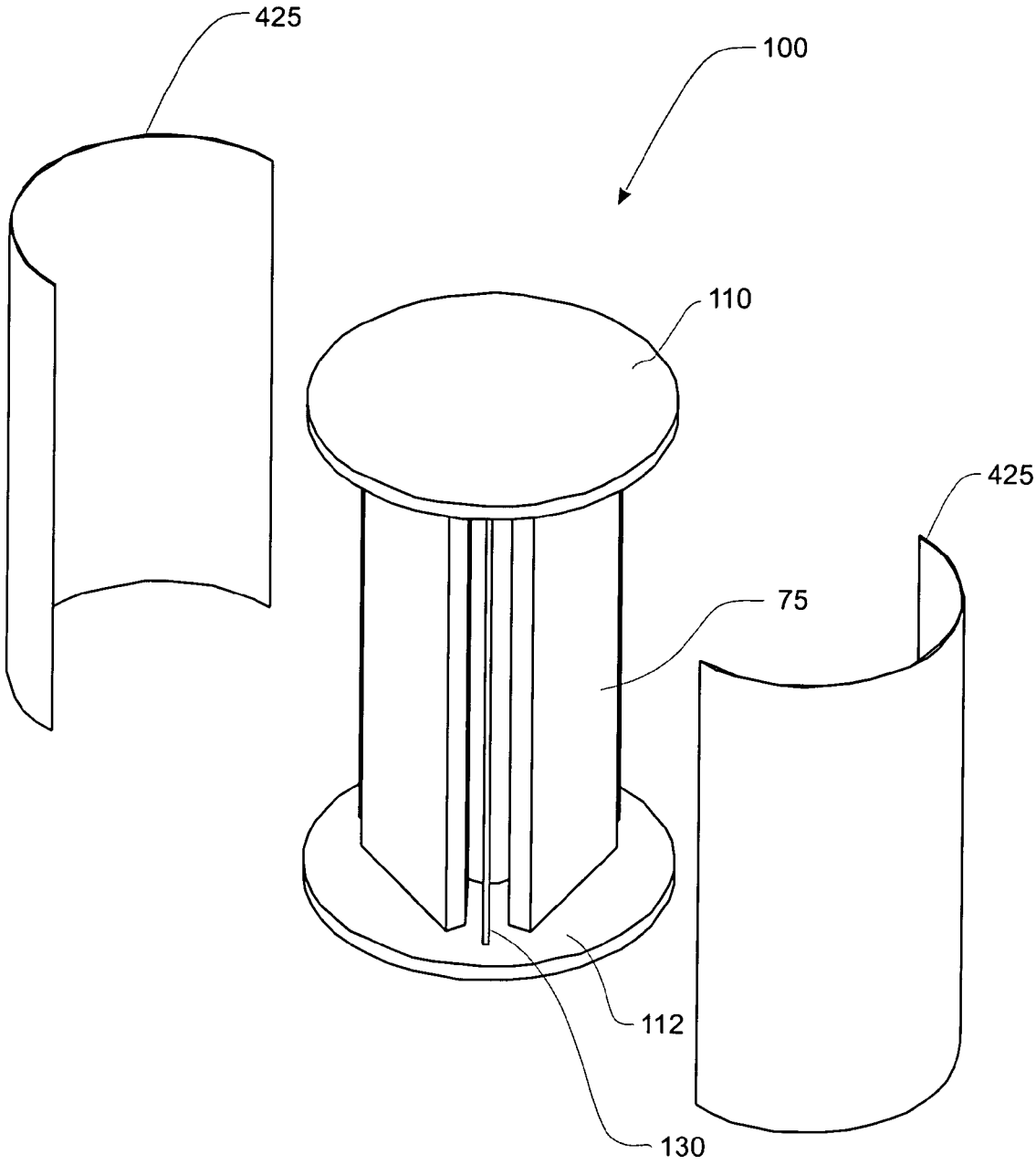
FIG. 4D is a perspective, partly exploded schematic view of the support structure of FIG. 4A, shown with antenna panels mounted thereto and with a shroud.

FIG. 4C is a schematic, perspective, partly exploded view of the support structure 100, showing the support structure 100 with antenna panels 75 mounted via the mounting brackets 402 and 404 (not shown in this figure, see FIG. 4A). This figure also shows the wings 130 including the webs, but omitting the peripheral or distal flanges. FIG. 4D shows the support structure 100 and a two-piece shroud 425 that is configured to be fitted onto and over the exterior of the support structure 100 so as to enclose substantially all of the support structure 100 and any antennas or associated equipment that may be mounted to the support structure. The shroud 425 could be one piece or multiple pieces, and can be fixed or have access doors to make it easy to reach the antennas or other parts of the tower assembly. Preferably, the shroud is configured to hide or obscure at least a substantial portion of the support structure 100 from view. It can also be configured to provide some protection of the support structure 100, and any antenna or associated equipment mounted thereto, from external forces and weather. The shroud preferably is made of a vinyl or polymer material that is lightweight and resistant to weathering due to exposure to the elements. Of course, to the extent that the shroud covers the antennas, the shroud should be of a material that is transparent to RF energy.

Figure 4E:
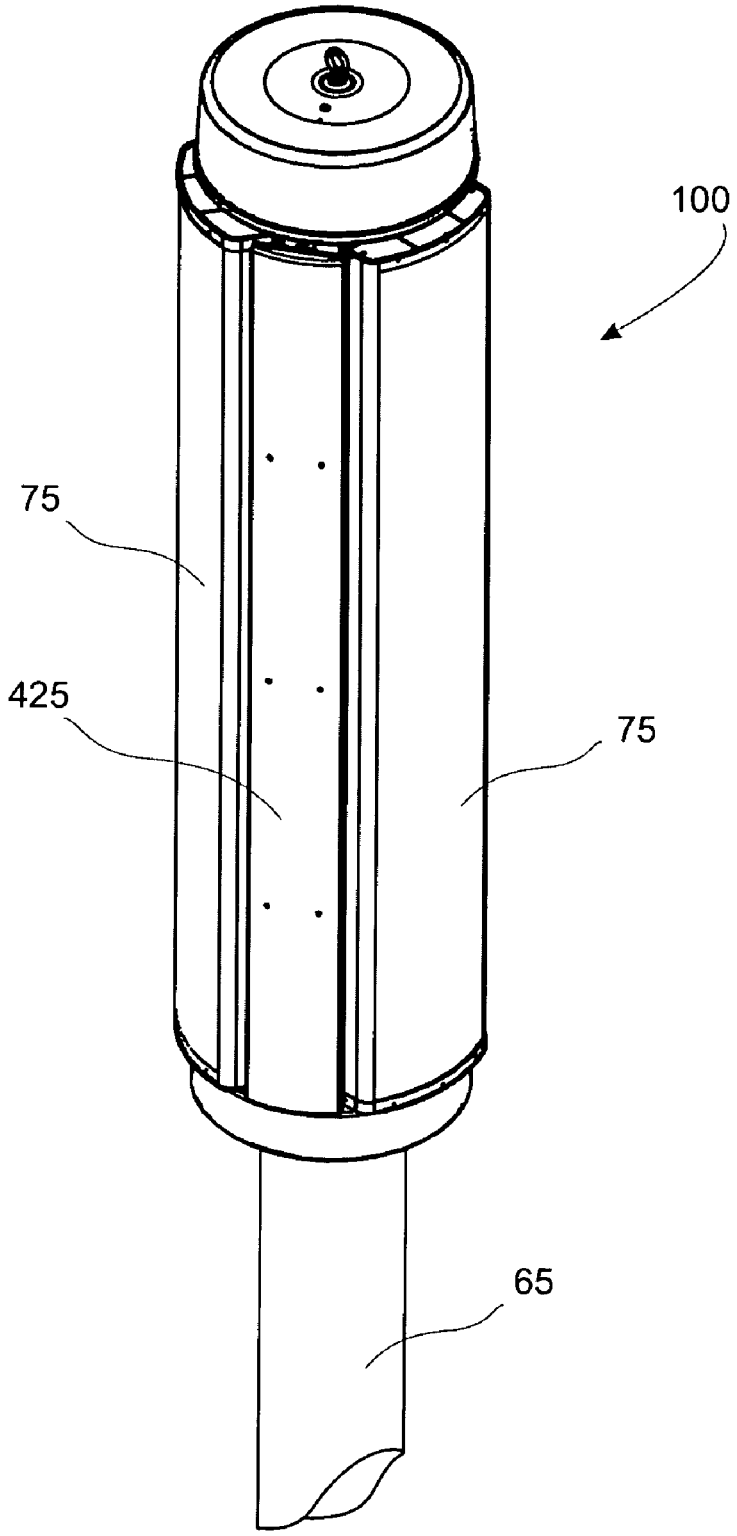
FIG. 4E is a perspective view of the support structure of FIG. 4A in a commercial form, shown with antenna panels mounted thereto and mounted to a tower mast.

FIG. 4E shows a commercial form of the support structure 100 mounted to a tower mast 65, loaded with antenna panels mounted thereon and covered at least in part with shrouds 425 between antenna panels.

Figure 5A:
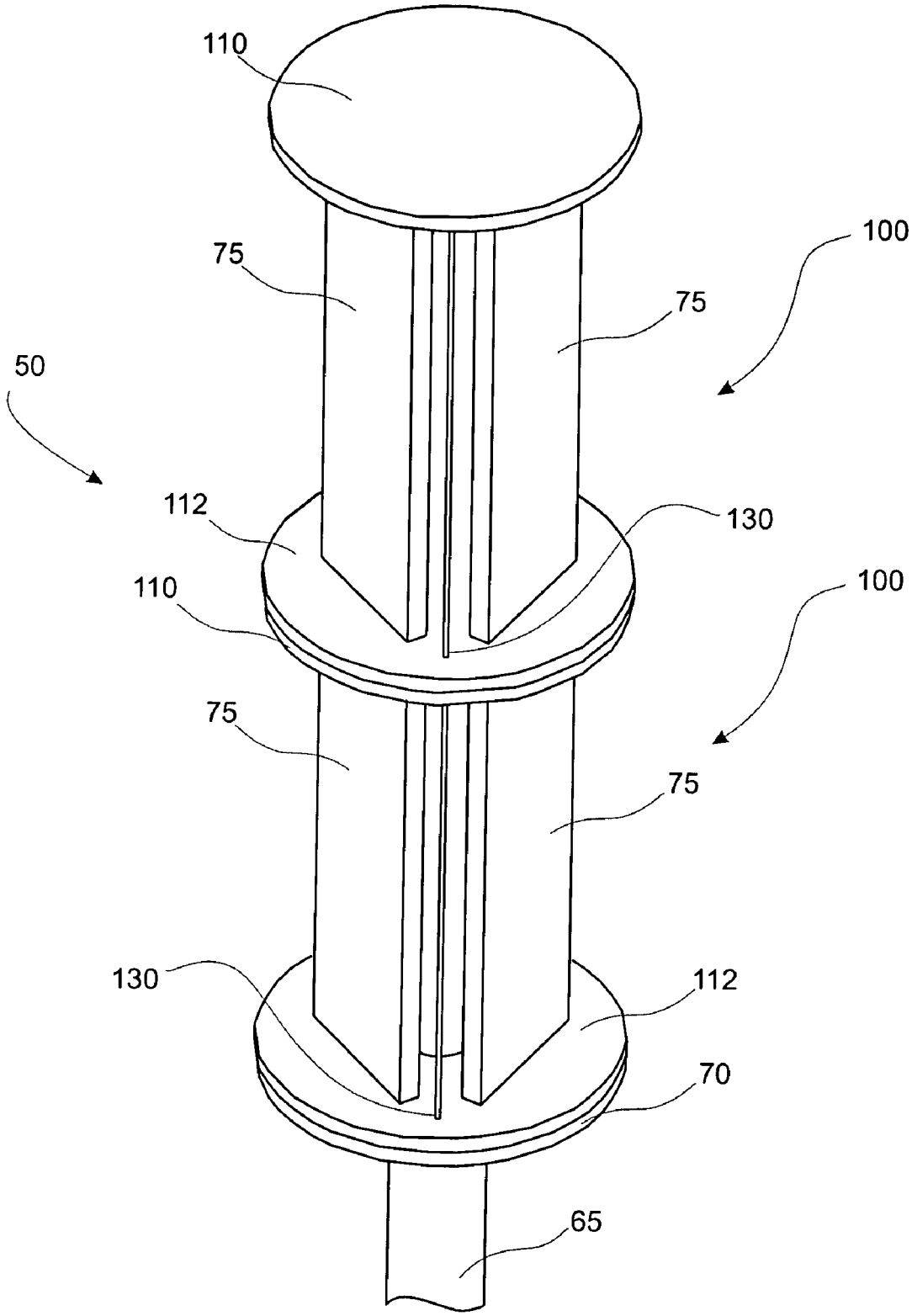
FIG. 5A is a schematic, perspective illustration of an antenna tower according to the present invention and having two support structures stacked one on top of the other.
Figure 5B:
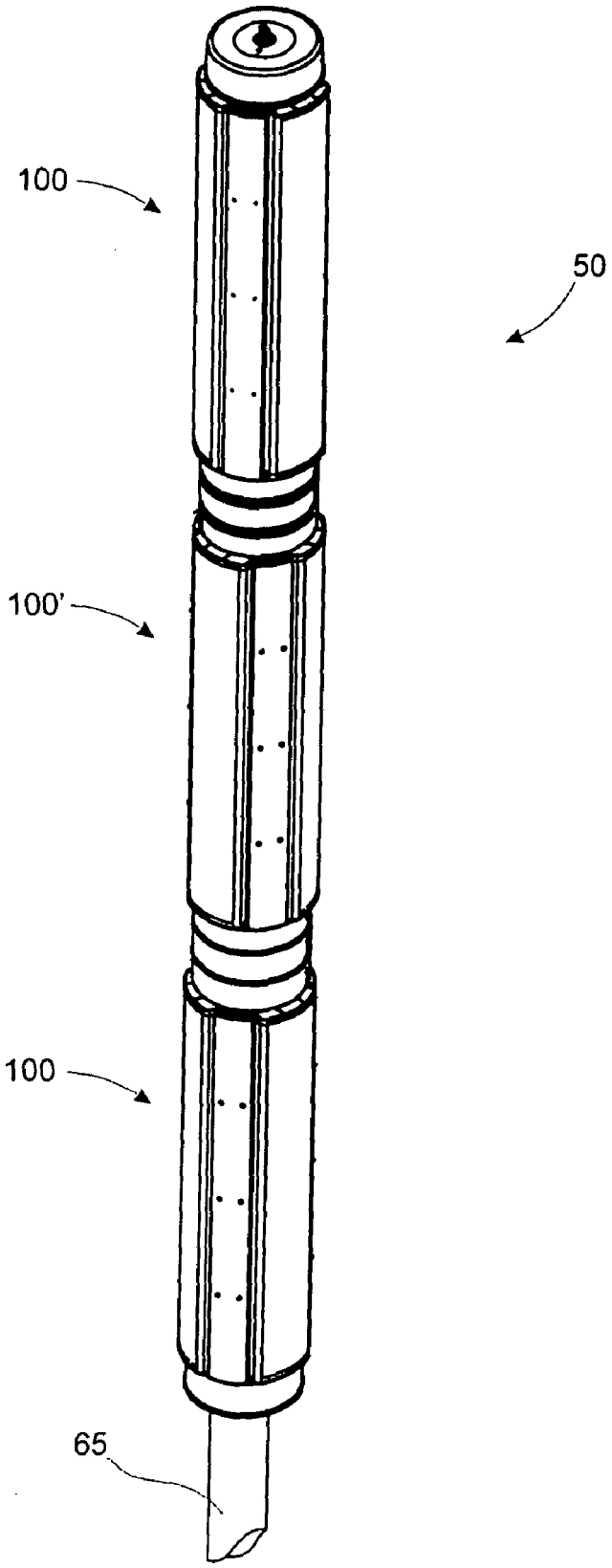
FIG. 5B is a schematic, perspective illustration of an antenna tower according to the present invention in a commercial form and having two support structures stacked one on top of the other.

FIG. 5A shows an embodiment of an antenna tower 50 wherein two support structures 100 are stacked vertically, one on top of the other and FIG. 5B shows an embodiment of an antenna tower 50 wherein three support structures 100, 100', 100 are stacked vertically, one on top of the other. This configuration allows for the placement of more antennas/antenna panels on the antenna tower 50. Also, as shown in FIG. 5B, one or more of the support structures (e.g., middle support structure 100') can be oriented at a different azimuth orientation from the other support structures 100, 100. While only two or three support structures are shown stacked, it will be recognized that more than three support structures 100 may be stacked one on top of the other, as may be desired. Further, each support structure can be fitted with a shroud 425 (not shown here) as shown and discussed above with respect to FIG. 4D.

It should be emphasized that the above-described embodiments of the present invention, particularly, any "preferred" embodiments, are merely possible examples of implementations, and merely serve to set forth a clear understanding of the principles of the invention. Many variations and modifications may be made to the above-described embodiment(s) of the invention without departing substantially from the spirit and principles of the invention. All such modifications and variations are intended to be included herein within the scope of the present invention and protected by the following claims.

We claim:

1. An antenna tower module for mounting to an antenna mast and for supporting one or more antennas, the antenna lower module comprising:

a bottom plate for mounting to the mast or to another module;

a top plate spaced apart from the bottom plate; and a multi-vaned beam extending between the bottom plate and the top plate, the multi-vaned beam including:

a central post; and a plurality of stiffening vanes extending generally radially outwardly from the central post, each of the stiffening vanes comprising a plurality of web portions, wherein the plurality of web portions extend from the bottom plate to the top plate.

2. An antenna tower module as claimed in claim 1 further comprising a distal flange at a distal end of each of the vanes and extending transversely to the radially extending vanes.

3. An antenna tower module as claimed in claim 1 wherein the central post has a circular cross-section.

4. An antenna tower module as claimed in claim 1 wherein the central post has a rectangular cross-section.

5. An antenna tower module as claimed in claim 1 wherein the plurality of stiffening vanes comprises at least three vanes.

6. An antenna tower module as claimed in claim 5 wherein the plurality of stiffening vanes are equally spaced from one another.

7. An antenna tower module as claimed in claim 1, wherein the plurality of stiffening vanes are unevenly spaced from one another.

8. An antenna tower module as claimed in claim 1 wherein each of the vanes is discontinuous.

9. An antenna tower module as claimed in claim 1 wherein each of the vanes is welded to the central post at two or more locations between the top plate and the bottom plate.

10. An antenna tower module as claimed in claim 5 wherein the at least three vanes comprises four vanes.

11. An antenna tower module as claimed in claim 10 wherein spacing between the four vanes is selected to define two relatively large recesses for receiving antennas therein and two relatively smaller recesses.

12. An antenna tower module as claimed in claim 1 further comprising a shroud for visually obscuring the multi-vaned beam and any antennas mounted thereto.

13. An antenna tower module as claimed in claim 1 wherein the top plate and the bottom plate are circular.

14. An antenna tower module as claimed in claim 1 wherein the top plate and the bottom plate are rectangular.

15. An antenna tower module as claimed in claim 1 wherein the top plate and the bottom plate are shaped to generally match or coordinate with the shape of a pattern formed by the multi-vaned beam.

16. An antenna tower comprising:

a mast;

at least one antenna tower module mounted to the antenna mast for supporting one or more antennas, the antenna tower module including:

a bottom plate for mounting to the mast or to another module;

a top plate spaced from the bottom plate; and a multi-gusseted beam extending between the bottom plate and the top plate, the multi-gusseted beam including a central post and a plurality of stiffening gussets extending generally radially outwardly from the central post; and extending between the top plate and the bottom plate and one or more antennas mounted to the antenna tower module.

17. An antenna tower is claimed in claim 16 wherein the at least one antenna tower module comprises at least two antenna tower modules, with the first of the modules being mounted atop the mast and the second of the modules being mounted atop the first module.

18. An antenna tower as claimed in claim 16 further comprising flanges at the distial ends of the gussets and extending transversely to the radially extending gussets and along the entire length of the distal ends of the flanges.

19. An antenna tower as claimed in claim 17 wherein the first antenna lower module has a different number of radially extending gussets than the second antenna tower module.

20. An antenna tower is claimed in claim 17 are in the first antenna tower module has the same number of radially extending gussets as the second antenna tower module.

21. An antenna tower as claimed in claim 16 further comprising a shroud for visually obscuring the antennas mounted to the antenna tower modules.

22. In an antenna tower assembly of the type having a pole or mast, and including an upper portion comprising a central post having first end and a second end, a top place connected to the first end of the central post and a bottom plate connected to the second end of the central post for mounting antennas thereto, the improvement therein comprising stiffening the upper portion of the antenna tower assembly with a plurality of structural webs extending radially from the central post and each structural web having a first end connected the upper plate and a second end connected to the lower plate.

23. The improvement of claimed 22 further comprising transversely extending flanges provided at the distal ends of the structural webs and extending transversely to be structural webs.

24. An antenna tower support structure for mounting to an antenna mast and for supporting one or more antennas, the antenna tower support structure comprising:

a bottom element for mounting to the mast or to another support structure;

a cap spaced from the bottom element; and a beam extending between the bottom element and the cap, the beam including a central post and a plurality of webs extending generally radially outwardly from the central post, wherein the plurality of webs extend between the bottom element and the cap.

25. An antenna tower support structure as claimed in claim 24 further comprising outer flanges, one each at a distal end of each of the webs and extending transversely to the webs.

26. An antenna tower support structure as claimed in claim 24 wherein the plurality of webs are equally spaced from one another.

27. An antenna tower support structure as claimed in claim 24 wherein the plurality of webs are not equally spaced from one another.

28. An antenna tower support structure as claimed in claim 24 wherein at least one of the webs is perforated.

29. An antenna tower support structure for mounting to an antenna mast and for supporting one or more antennas, the antenna tower support structure consisting of:

a bottom member for mounting for the mast or to another module;

a top member spaced apart from the bottom member;

a central post extending between the top member and the bottom member; and a plurality of peripheral stiffening flanges spaced radially outwardly from the central post extending between the bottom member and the top member.

* * * * *